US006725477B2

(12) United States Patent
Ciaglia et al.

(10) Patent No.: US 6,725,477 B2
(45) Date of Patent: Apr. 27, 2004

(54) FITTED SHEETS COMBINATION

(75) Inventors: Earle L. Ciaglia, Orland Park, IL (US); Edwin M. Ciaglia, Orland Park, IL (US)

(73) Assignee: Bedmaid Corporation, Overland Park, IL (US)

( * ) Notice: Subject to any disclaimer, the term of this patent is extended or adjusted under 35 U.S.C. 154(b) by 0 days.

(21) Appl. No.: 09/941,242

(22) Filed: Aug. 27, 2001

(65) Prior Publication Data

US 2003/0037374 A1 Feb. 27, 2003

(51) Int. Cl.[7] ..... A47G 9/00
(52) U.S. Cl. ..... 5/497; 5/502; 5/500
(58) Field of Search ..... 5/497, 495, 498, 5/499, 502, 500

(56) References Cited

U.S. PATENT DOCUMENTS

| | | | | | |
|---|---|---|---|---|---|
| 2,577,178 | A | * | 12/1951 | Bellinger | 5/485 |
| 2,679,056 | A | * | 5/1954 | Simpson | 5/485 |
| 3,824,640 | A | * | 7/1974 | Golden | 5/485 |
| 3,868,735 | A | * | 3/1975 | Ross | 5/334 |
| 4,308,626 | A | * | 1/1982 | Weiss | 5/485 |
| 4,912,790 | A | * | 4/1990 | Macdonald | 5/497 |
| 4,964,184 | A | * | 10/1990 | Lewis | 5/496 |
| 5,042,098 | A | * | 8/1991 | Stultz | 5/485 |
| 5,165,128 | A | * | 11/1992 | Honig | 5/482 |
| 5,189,744 | A | * | 3/1993 | Roberts | 5/497 |
| 5,442,822 | A | * | 8/1995 | Diaz | 5/497 |
| 5,515,799 | A | * | 5/1996 | Heptner | 112/475.08 |
| 5,615,425 | A | * | 4/1997 | Corente | 297/229 |
| 6,041,456 | A | * | 3/2000 | Pharr | 5/497 |
| 6,049,925 | A | * | 4/2000 | Lewis | 5/482 |
| 6,061,851 | A | * | 5/2000 | Crowell | 5/482 |
| 6,108,836 | A | * | 8/2000 | Keene, III | 5/482 |

* cited by examiner

*Primary Examiner*—Robert J. Sandy
*Assistant Examiner*—Katherine W Mitchell
(74) *Attorney, Agent, or Firm*—Niro, Scavone, Haller & Niro

(57) ABSTRACT

A fitted sheets combination includes a fitted bottom sheet and a top sheet. The bottom corners of the top sheet are formed of a widthwise cut edge and a lengthwise cut edge meeting at an angle of more than 90° and being attached to each other along respective lengths. The bottom corners of the top sheet are attached to the bottom corners of the bottom sheet to form a foot pocket at a bottom area of the combination.

10 Claims, 2 Drawing Sheets

FITTED SHEETS COMBINATION

FIELD OF THE INVENTION

This invention relates to a fitted sheets combination including a top sheet and a bottom sheet for fitting over a mattress.

BACKGROUND OF THE INVENTION

Fitted bottom sheets are known including an overhang which overhangs the sides of a mattress and is drawn inwardly under the mattress by elastic strips so that the bottom sheet is tightly spread over the top of the mattress and held securely in place. When a separate flat top sheet is used with the fitted bottom sheet, it must be carefully adjusted and tucked in with hospital corners, and even then the top sheet comes untucked readily. This makes making up the bed an unnecessarily complicated procedure for everyone, and a potentially difficult procedure for those with vision problems or other physical difficulties.

Fitted top sheets are also known having the same type of fitting at the bottom as the fitted bottom sheets, but this construction leaves little room at the bottom for the sleeper's feet.

It is even known to have a combination of a fitted bottom sheet with an attached top sheet. However, the known constructions for such combinations either provide too little space for the sleeper's feet and/or require complicated constructions that are relatively expensive and difficult to handle when making up the bed.

OBJECTS AND SUMMARY OF THE INVENTION

Accordingly, it is an object of the present invention to provide a fitted sheets combination that avoids the above-discussed difficulties of the prior art.

It is another object of the present invention to provide a fitted sheets combination that makes it fast and easy to make up a bed.

It is yet another object of the present invention to provide a fitted sheets combination that attaches the top sheet to the bottom sheet so as to keep the top sheet properly aligned on the mattress.

It is a further object of the present invention to provide a fitted sheets combination that provides a comfortable amount of room for the sleeper's feet while maintaining the alignment of the top sheet on the mattress.

It is still a further object of the present invention to provide a fitted sheets combination that provides all of the above advantages while being cost efficient for manufacture.

The above objects, as well as additional advantages, will be realized in the practice of the invention as herein described. In its broadest embodiment, the fitted sheets combination comprises a fitted bottom sheet having right and left top corners and right and left bottom corners, wherein each of the corners is formed into a pocket adapted to receive a corresponding corner or a mattress onto which the bottom sheet is fittable, and a top sheet having a top edge, a bottom edge, a left side edge, a right side edge and left and right bottom corners. The left bottom corner of the top sheet is formed of a straight widthwise cut edge extending inwardly from the left edge and a straight lengthwise cut edge extending inwardly from the bottom edge, the widthwise cut edge and the lengthwise cut edge meeting at an angle of more than 90° and being attached to each other along respective lengths in a first seam. The right bottom corner of the top sheet is formed of a straight widthwise cut edge extending inwardly from the right edge and a straight lengthwise cut edge extending inwardly from the bottom edge, the widthwise cut edge and the lengthwise cut edge meeting at the angle of more than 90° and being attached to each other along respective lengths in a second seam. Finally, the left bottom corner of the top sheet is attached to the left bottom corner of the bottom sheet and the right bottom corner of the top sheet is attached to the right bottom corner of said bottom sheet to form a foot pocket at a bottom area of the combination.

Thus, the angle of the cuts and the length of the seams that create the fitted bottom corners create a foot pocket at the foot of the top sheet, eliminating the tight and penned in feeling for the sleeper's feet when no foot pocket exists. Because of the unique angle and length of the seams of the top sheet, the seam of the top sheet is greater than the corresponding fitted seam of the bottom sheet. Moreover, elastic is advantageously provided on all four sides of the bottom sheet.

As a result, the bed is properly made up and the top sheet appears to be form fitted, and yet has the additional fabric for the foot pocket. At the same time, the connected top and bottom sheets remain tucked in under the mattress at the foot of the bed.

Various sizes of the combination are possible in accordance with the present invention to fit the various sizes of mattresses available today, and other sizes of the combination are possible as new sizes of mattresses may develop. Each size of the combination has its own unique degree of angle cut and seam length to form the fitted corners at the foot of the top sheet.

The combination in accordance with the present invention eliminates the discomfort of prior sheets where the sleeper must pull and kick at the sheets to try to gain foot room and, in the case of separate sheets, pull out the foot of the top sheet from under the mattress. This novel construction retains the form fitted appearance and comfort of a fitted bed.

People with disabilities, such as sight impaired people, can more easily make their own beds with the combination in accordance with the present invention. The top sheet is automatically tucked in at the foot of the bed with both sides of the top sheet overhanging the sides of the mattress having the same correct length and width. In addition to this correct overhang, the proper side of the top sheet is automatically facing down, so that the matching color, pattern or design of the sheet set is correct. Guesswork in making the bed is eliminated.

These and other objects, features and aspects of the present invention will be apparent from the following description of the preferred embodiments taken in conjunction with the attached drawings.

BRIEF DESCRIPTION OF THE DRAWINGS

The invention will be further described with reference to the drawings in which like elements are represented by the same number.

DETAILED DESCRIPTION OF THE PREFERRED EMBODIMENTS

Figure 1:
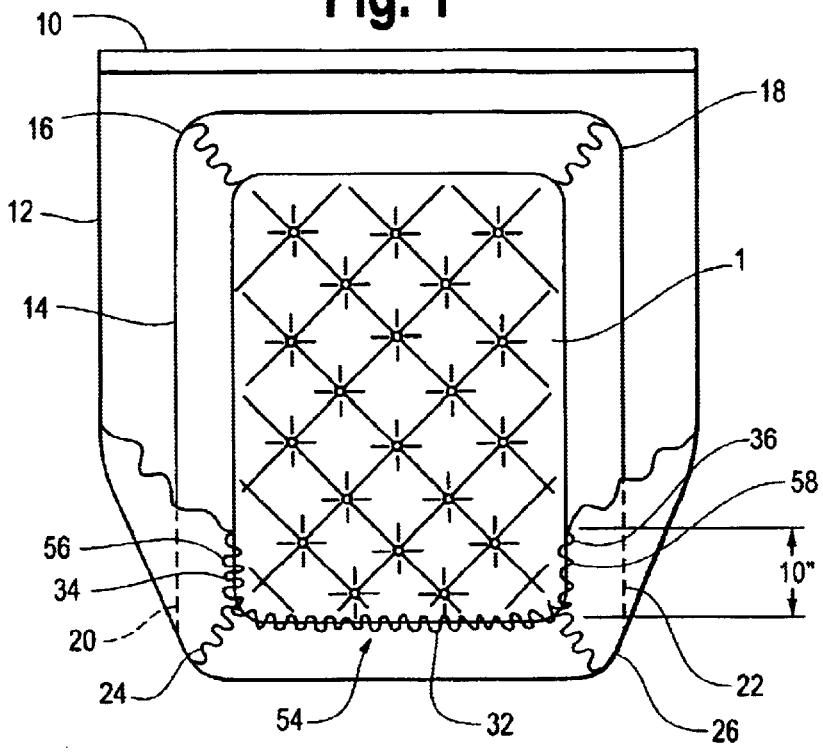
FIG. 1 is a bottom view of a fitted sheets combination in accordance with a preferred embodiment of the present invention.

With reference to FIG. 1, a fitted sheets combination 10 in accordance with the present invention is shown as view from the underside of a mattress 1 made up with the combination 10. The combination 10 includes a top sheet 12 and a bottom sheet 14. In accordance with an advantageous aspect of the present invention, the four corners 16, 18, 20, 22 of the bottom sheet 14 are cut out and then sewn together along the cut lines, the two bottom corners 24, 26 are also cut out and then sewn together along the cut lines, and then the bottom corners 20, 22 of the bottom sheet 14 are sewn to the bottom corners of the top sheet 12. As described below, the construction of these cutouts and the seams joining them together creates the novel combination wherein the top sheet 12 remains attached and aligned on the mattress 1 while still providing ample foot room for the sleeper's feet.

Figure 2:
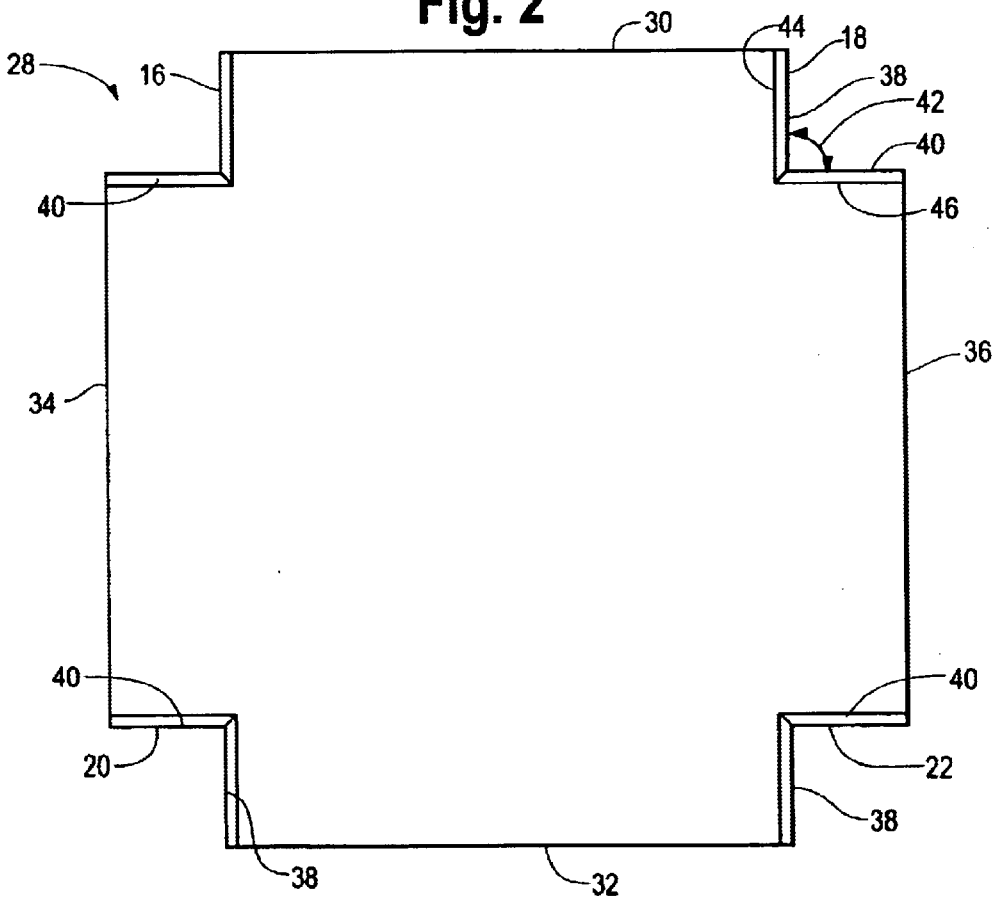
FIG. 2 is a top view of a blank from which the bottom sheet of the combination is formed.

FIG. 2 shows a top view of a blank 28 from which the bottom sheet 14 is sewn. Blank 28 has a top edge 30, a bottom edge 32, a left edge 34 and a right edge 36. The length from the top edge 30 to the bottom edge 32 is denominated BL1, while the width from the left edge 34 to the right edge 36 is denominated BW1.

Blank 28 also has four cutout corners 16, 18, 20 and 22, all of which have the identical construction. Taking corner 18 as an example, the cutout portion is formed of a lengthwise cut edge 38 and a widthwise cut edge 40 meeting at an angle 42 of 90°. Interior to the lengthwise cut edge 38 and parallel thereto is a lengthwise sew line 44, and interior to the widthwise cut edge 40 and parallel thereto is a widthwise sew line 46. These two sew lines 44, 46 also meet at a 90° angle. The length from the widthwise cut edge 40 of corner 18 to the widthwise cut edge 40 of corner 22 is denominated BL2, and is equal to the length from the widthwise cut edge 40 of corner 16 to the widthwise cut edge 40 of corner 20. The width from the lengthwise cut edge 38 of corner 18 to the lengthwise cut edge 38 of corner 16 is denominated BW2, and is equal to the width from the lengthwise cut edge 38 of corner 20 to the lengthwise cut edge 38 of corner 22.

As will be explained below, the sizes of the cut edges 38, 40, when combined with the sizes and angles of corresponding cut edges on the top sheet 12 create the advantageous foot pocket of the present invention for different sizes of combinations.

To form the blank 28 into the bottom sheet 14, first elastic 48 is sewn into the center portion of the top, bottom and side edges 30, 32, 34, 36 to provide the desired constriction of the edges to hold the completed bottom sheet 14 securely on the mattress. Then the lengthwise and widthwise cut edges 38, 40 of each corner are sewn together along the sew lines 44, 46, including a bottom left seam 45 and a bottom right seam 47.

Figure 3:
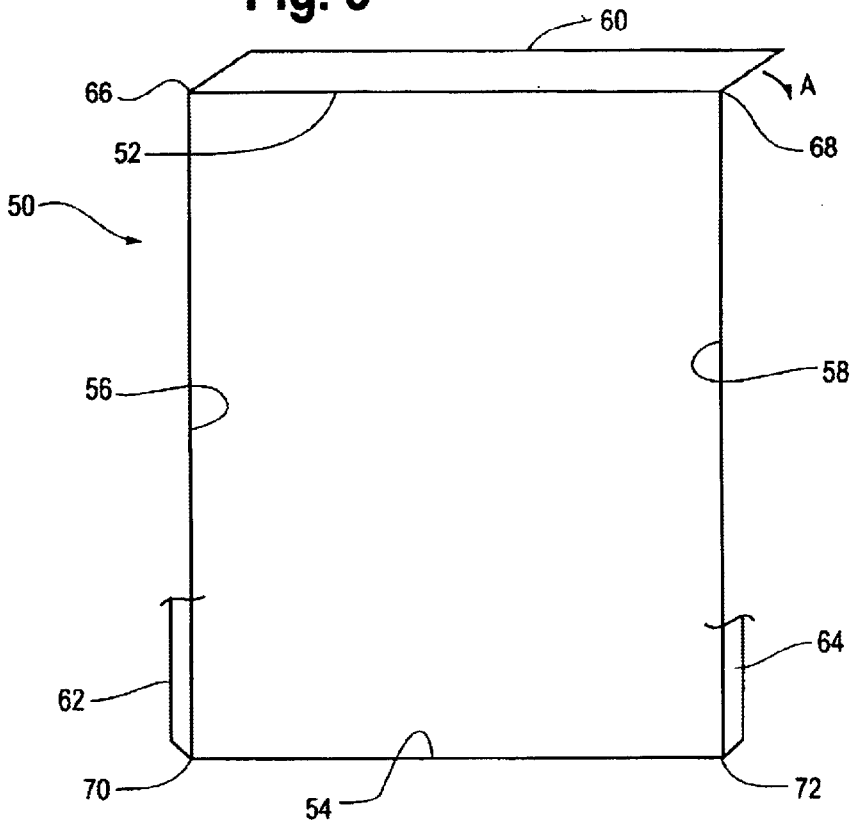
FIG. 3 is a top view of a blank from which the top sheet of the combination is formed at an initial stage of manufacture.

FIG. 3 shows a top view of a blank 50 from which the top sheet 12 is made. Blank 50 has a top edge 52, a bottom edge 54, a left edge 56 and a right edge 58. The length from the top edge 52 to the bottom edge 54 is denominated TL1, while the width from the left edge 56 to the right edge 58 is denominated TW1.

Blank 50 also includes extra material along the top and side edges to form hems. Thus, extending along the top edge 52 is top hem strip 60, extending along the left edge 56 is left hem strip 62, and extending along the right edge 58 is right hem strip 64. Top hem strip 60 is folded under in the direction of arrow A and sewn prior to cutting the blank 50, as shown in FIG. 3.

Blank 50 also has four corners 66, 68, 70 and 72. Top corners 66 and 68 have the same construction, and in particular are left uncut and square to form the head of the top sheet 12. However, bottom corners 70 and 72 will be cut out and sewn in accordance with the present invention to make the advantageous foot pocket.

Figure 4:
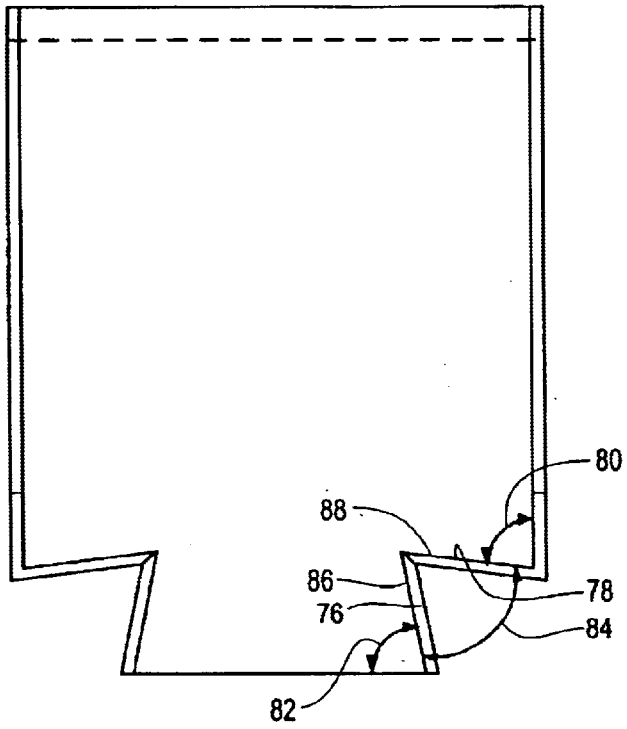
FIG. 4 is a top view of the blank from which the top sheet of the combination is formed at a subsequent stage of manufacture.

FIG. 4 shows the blank 50 after the bottom corners 70, 72 have been cut. The cut bottom corners 70, 72 have the identical construction. Taking corner 72 as an example, the cutout portion is formed of a generally lengthwise cut edge 76 and a generally widthwise cut edge 78. Unlike the cut edges on the bottom sheet, these cut edges 76, 78 are not made parallel to the sides and bottom of the blank 50 to meet at an angle of 90°. Instead, cut edge 78 is made at an angle 80 somewhat more than an angle of 90° from right side edge 58 and cut edge 76 is made at an angle 82 somewhat more than an angle of 90° from bottom edge 54, so that cut edge 76 meets cut edge 78 at an angle 84 somewhat more than an angle of 90°.

Interior to the lengthwise cut edge 76 and parallel thereto is a lengthwise sew line 86, and interior to the widthwise cut edge 78 and parallel thereto is a widthwise sew line 88. These two sew lines 86, 88 also meet at the angle 84. The length from the top edge 52 to widthwise cut edge 78 of corner 72 and to the widthwise cut edge 78 of corner 70 is denominated TL2 The width from the lengthwise cut edge 76 of corner 70 to the lengthwise cut edge 76 of corner 72 is denominated TW2.

To form the blank 50 into the top sheet 12, the lengthwise and widthwise cut edges 76, 78 of each bottom corner are sewn together along the sew lines 86, 88 to form left and right seams 88, 90 (see FIG. 1).

Finally, the top sheet 12 is attached to the bottom sheet 14 by sewing the bottom edge 54 of the top sheet 12 to the bottom edge 32 of the bottom sheet 14, sewing the left edge 56 of the top sheet 12 to the left edge 34 of the bottom sheet 14 from the bottom edges up for about 10 inches, and sewing the right edge 58 of the top sheet 12 to the right edge 36 of the bottom sheet 14 from the bottom edges up for about 10 inches The relevant dimensions of the top and bottom sheets and their cut edges are as follows.

Standard Twin Sheet

When the bottom sheet 14 is adapted to fit a standard twin size mattress, the widthwise cut edges 40 and the lengthwise cut edges 38 of the bottom sheet 14 are all 11 inches long, the widthwise cut edges 78 and the lengthwise cut edges 76 of the top sheet 12 are all 13 inches long, and the angle of more than 90° is 90.5°. For the bottom sheet 14, the length BL1 is 97 inches, the length BL2 is 75 inches, the width BW1 is 61 inches and the width BW2 is 39 inches. For the top sheet 12, the length TL1 is 96 inches, the length TL2 is 80 inches, the width BW1 is 66 to 68 inches, the width BW2 is 39 inches, and the hem is 4 inches wide.

Extra Long Twin Sheet

When the bottom sheet 14 is adapted to fit a long twin size mattress, the widthwise cut edges 40 and the lengthwise cut edges 38 of the bottom sheet 14 are all 11 inches long, the widthwise cut edges 78 and the lengthwise cut edges 76 of the top sheet 12 are all 13 inches long, and the angle of more than 90° is 91.5°. For the bottom sheet 14, the length BL1 is 102 inches, the length BL2 is 80 inches, the width BW1 is 61 inches and the width BW2 is 39 inches. For the top sheet 12, the length TL1 is 102 inches, the length TL2 is 86 inches, the width BW1 is 68 inches, the width BW2 is 39 inches, and the hem is 4 inches wide.

Standard Full Sheet

When the bottom sheet 14 is adapted to fit a standard full size mattress, the widthwise cut edges 40 and the lengthwise cut edges 38 of the bottom sheet 14 are all 13 inches long, the widthwise cut edges 78 and the lengthwise cut edges 76 of the top sheet 12 are all 13 inches long, and the angle of more than 90° is 90.5°. For the bottom sheet 14, the length BL1 is 97 inches, the length BL2 is 75 inches, the width BW1 is 76 inches and the width BW2 is 54 inches. For the top sheet 12, the length TL1 is 96 inches, the length TL2 is 80 inches, the width BW1 is 81 to 83 inches, the width BW2 is 54 inches, and the hem is 4 inches wide.

Standard Queen Sheet

When the bottom sheet 14 is adapted to fit a standard queen size mattress, the widthwise cut edges 40 and the lengthwise cut edges 38 of the bottom sheet 14 are all 13 inches long, the widthwise cut edges 78 and the lengthwise cut edges 76 of the top sheet 12 are all 13 inches long, and the angle of more than 90° is 92°. For the bottom sheet 14, the length BL1 is 102 inches, the length BL2 is 80 inches, the width BW1 is 82 inches and the width BW2 is 60 inches. For the top sheet 12, the length TL1 is 102 inches, the length TL2 is 86 inches, the width BW1 is 90 to 92 inches, the width BW2 is 60 inches, and the hem is 4 inches wide.

Standard King Sheet

When the bottom sheet 14 is adapted to fit a standard king size mattress, the widthwise cut edges 40 and the lengthwise cut edges 38 of the bottom sheet 14 are all 13 inches long, the widthwise cut edges 78 and the lengthwise cut edges 76 of the top sheet 12 are all 13 inches long, and the angle of more than 90° is 92°. For the bottom sheet 14, the length BL1 is 102 inches, the length BL2 is 80 inches, the width BW1 is 100 inches and the width BW2 is 78 inches. For the top sheet 12, the length TL1 is 102 inches, the length TL2 is 86 inches, the width BW1 is 108 to 110 inches, the width BW2 is 78 inches, and the hem is 4 inches wide.

While the present invention has been described with reference to the foregoing embodiments, changes and variations may be made therein which fall within the scope of the appended claims.

We claim:

1. A fitted sheet combination comprising:

a fitted bottom sheet having right and left top corners and right and left bottom corners, wherein each of said corners is formed into a pocket adapted to receive a corresponding corner or a mattress onto which said bottom sheet is fittable; and a top sheet having a top edge, a bottom edge, a left side edge, a right side edge and left and right bottom corners, wherein said left bottom corner of said top sheet is formed of a straight widthwise cut edge extending inwardly from said left edge and a straight lengthwise cut edge extending inwardly from said bottom edge, said widthwise cut edge and said lengthwise cut edge meeting at an exterior angle of more than 90° and being attached to each other along respective lengths in a first seam;

wherein said right bottom corner of said top sheet is formed of a straight widthwise cut edge extending inwardly from said right edge and a straight lengthwise cut edge extending inwardly from said bottom edge, said widthwise cut edge and said lengthwise cut edge meeting at said exterior angle of more than 90° and being attached to each other along respective lengths in a second seam; and wherein said left bottom corner of said top sheet is attached to said left bottom corner of said bottom sheet and said right bottom corner of said top sheet is attached to said right bottom corner of said bottom sheet to form a foot pocket at a bottom area of said combination.

2. The combination of claim 1, wherein for each of said left and right corners of said bottom sheet, the widthwise edge cut is sewn to said lengthwise edge cut along the respective seam.

3. The combination of claim 1, wherein said left bottom corner of said top sheet is attached to the left bottom corner of said bottom sheet and said right bottom corner of said top sheet is attached to the right bottom corner of said bottom sheet by sewing a U-shaped seam running across bottom edges of said top and bottom sheets and partway up left and right side edges of said top and bottom sheets.

4. The combination of claim 1, wherein each corner of said bottom sheet is formed into said pocket by cutting out along a widthwise cut edge and a lengthwise cut edge meeting at a 90° angle and attaching the respective widthwise cut edge to the respective lengthwise cut edge along a respective seam, said bottom left corner of said bottom sheet having a third seam and said bottom right corner of said bottom sheet having a fourth seam.

5. The combination of claim 4, wherein said first and second seams have a first length and said third and fourth seams have a second length, said first length being greater than said second length.

6. The combination of claim 5, wherein said bottom sheet is adapted to fit a standard twin size mattress, wherein said widthwise cut edges and said lengthwise cut edges of said bottom sheet are all 11 inches long, wherein said widthwise cut edges and said lengthwise cut edges of said top sheet are all 13 inches long, and said exterior angle of more than 90° is 90.5°.

7. The combination of claim 5, wherein said bottom sheet is adapted to fit a long twin size mattress, wherein said widthwise cut edges and said lengthwise cut edges of said bottom sheet are all 11 inches long, wherein said widthwise cut edges and said lengthwise cut edges of said top sheet are all 13 inches long, and said exterior angle of more than 90° is 91.5°.

8. The combination of claim 5, wherein said bottom sheet is adapted to fit a standard full size mattress, wherein said widthwise cut edges and said lengthwise cut edges of said bottom sheet are all 11 inches long, wherein said widthwise cut edges and said lengthwise cut edges of said top sheet are all 13 inches long, and said exterior angle of more than 90° is 90.5°.

9. The combination of claim 5, wherein said bottom sheet is adapted to fit a standard queen size mattress, wherein said widthwise cut edges and said lengthwise cut edges of said bottom sheet are all 11 inches long, wherein said widthwise cut edges and said lengthwise cut edges of said top sheet are all 13 inches long, and said exterior angle of more than 90° is 92°.

10. The combination of claim 5, wherein said bottom sheet is adapted to fit a standard king size mattress, wherein said widthwise cut edges and said lengthwise cut edges of said bottom sheet are all 11 inches long, wherein said widthwise cut edges and said lengthwise cut edges of said top sheet are all 13 inches long, and said exterior angle of inure than 90° is 92°.

* * * * *

UNITED STATES PATENT AND TRADEMARK OFFICE

CERTIFICATE OF CORRECTION

PATENT NO. : 6,725,477 B2
DATED : April 27, 2004
INVENTOR(S) : Earle L. Ciaglia

It is certified that error appears in the above-identified patent and that said Letters Patent is hereby corrected as shown below:

Title page,
Item [73], Assignee, delete “Overland” and replace with -- Orland --.

Signed and Sealed this

Third Day of August, 2004

JON W. DUDAS
*Acting Director of the United States Patent and Trademark Office*